US006895303B1

(12) United States Patent
Krumm et al.

(10) Patent No.: US 6,895,303 B1
(45) Date of Patent: May 17, 2005

(54) PROCESS FOR CONTROLLING THE CONVEYING SPEED OF A TRANSPORTING TRACK

(76) Inventors: Josef Krumm, Sonnenbachweg 58 D-86169, Augsburg (DE); Josef Batzer, Grenzstraβe 48 D-86391, Stadtbergen (DE)

( * ) Notice: Subject to any disclaimer, the term of this patent is extended or adjusted under 35 U.S.C. 154(b) by 0 days.

(21) Appl. No.: 09/043,264

(22) PCT Filed: Nov. 18, 1996

(86) PCT No.: PCT/EP96/05083

§ 371 (c)(1),
(2), (4) Date: Mar. 12, 1998

(87) PCT Pub. No.: WO97/30923

PCT Pub. Date: Aug. 28, 1997

(30) Foreign Application Priority Data

Feb. 23, 1996 (DE) ..... 196 06 888

(51) Int. Cl.[7] ..... G06F 7/00

(52) U.S. Cl. ..... 700/223; 700/220; 198/572; 198/577; 271/202; 270/52.16; 270/58.29

(58) Field of Search ..... 700/220, 223; 198/358, 418.2, 572, 577; 271/202, 184, 303; 270/52.16, 52.29, 58.29, 58.03, 52.02, 32, 58.01, 59

(56) References Cited

U.S. PATENT DOCUMENTS 3,871,509 A * 3/1975 Kuster et al. ..... 198/577 X
4,177,979 A * 12/1979 Orsinger et al. ..... 270/52.16
4,429,781 A * 2/1984 Holzhauser ..... 198/577 X
4,479,640 A * 10/1984 Smith ..... 270/32
4,482,140 A 11/1984 Macey ..... 270/53
4,904,138 A 2/1990 Champeaux et al. ..... 412/8
4,938,335 A 7/1990 Canziani ..... 198/365
4,987,547 A * 1/1991 Rabindran et al. ..... 700/220
5,228,558 A * 7/1993 Hall ..... 198/577 X
5,280,895 A * 1/1994 Meier ..... 270/58.03
5,359,834 A * 11/1994 Holdensgaard et al. . 198/577 X
5,458,323 A * 10/1995 Magee et al. ..... 270/52.02
5,595,379 A * 1/1997 Hoang ..... 270/52.29 X
5,730,436 A * 3/1998 Viebach et al. ..... 270/52.29 X
5,899,453 A * 5/1999 Middelberg et al. ..... 271/184

FOREIGN PATENT DOCUMENTS

DE 3943089 12/1989 ..... G05D/13/00

* cited by examiner

*Primary Examiner*—Christopher P. Ellis
*Assistant Examiner*—Patrick Mackey

(57) ABSTRACT

In the case of a method of controlling the transport speed of a transport and gathering unit, wherein filling-material stacks are moved from an inlet to an outlet of the gathering path making use of at least one transport means and wherein filling-material units can selectively be added to the filling-material stacks at one or at several adding stations, at least one measure is determined for each filling-material stack at the inlet of the gathering path, each measure for each filling-material stack is increased at each adding station by a respective value corresponding to the filling-material unit added, if the filling-material stack has added thereto a filling-material unit, each measure of each filling-material stack is compared with a respective set value associated with the transport means, and the transport speed is controlled in dependence upon the result of the comparison.

22 Claims, 4 Drawing Sheets

PROCESS FOR CONTROLLING THE CONVEYING SPEED OF A TRANSPORTING TRACK

BACKGROUND OF THE INVENTION

1. Field of the Invention

The present invention refers to a method of controlling the transport speed of a transport and gathering path, especially of a gathering path used in a paper handling system.

2. Description of Prior Art

Paper handling systems are primarily used by large enterprises, banks, insurance companies, service-rendering enterprises, etc. In these enterprises, the paper handling systems, which use transport and gathering paths, serve to process large amounts of paper, such as invoices, reminders, statements of account, insurance policies or cheques.

In order to obtain at the end of the paper handling system a suitable compilation of various papers required, it is necessary that the paper handling system correctly processes the different papers when said papers have been printed. The processing takes place at successive stations of the paper handling system and comprises e.g. the steps of separating, folding, sorting, collecting and stapling the various papers as well as subsequent enveloping of the compiled filling material and stamping of the finished letter so that letters ready for dispatch are discharged at the outlet of the paper handling system.

In view of the fact that the above-mentioned different working processes are carried out at successive stations in the paper handling system, it is necessary to provide a connection between these various stations. This connection is established by a so-called gathering path which interconnects the individual stations of the paper handling system.

According to the prior art, the processing speed of the gathering path of such known paper handling systems is fixedly adjusted or it can be adjusted by an operator via operating elements. In apparatus of this kind, the total speed of the gathering path is reduced by the operator for all items processed in the gathering path if the stack height of the filling material is expected to exceed a maximum value. This results in a deterioration of the gathering path throughput.

Such processing systems, especially paper handling systems, are desired to show a broad processing spectrum with regard to the filling-material height and the filling-material weight that can be processed. This broad processing spectrum influences the structural design of the electric drive means. Upon constructing the drive means, two criteria influencing the drive costs and the processing capacity must be taken into account in the known systems.

For a maximum processing capacity, which is referred to as enveloping capacity in paper handling systems, the drive means must firstly be constructed such that, independently of the filling weight and the filling height, they are capable of producing the maximum acceleration moment required for the gathering path of e.g. the paper handling system. In most cases of pratical use, the permitted limit values for which the drive means are constructed are not reached. The structural design of the drive means is therefore oversized and subject to excessively high costs for these cases of use.

If, secondly, the drive means are constructed for a maximum processing capacity with a limited filling-material height and a limited filling-material weight, the system can only be operated at a reduced processing speed in cases of use where higher filling-material heights or higher filling-material weights occur at certain times or constantly. During a production cycle, the limit values admissible for a maximum processing speed are, however, often exceeded only in individual cases. It follows that a processing speed reduced throughout the whole production cycle will only result in an unnecessary reduction of the processing capacity, which is the enveloping capacity in the case of a paper handling system.

DE 3943089 A1 already discloses a means for controlling the operating speed of a processing machine including a feed path which is driven by a drive motor whose operating speed is controlled in dependence upon a distance between products on this feed path, said distance being detected by sensors.

SUMMARY OF THE INVENTION

It is an object of the present invention to provide a method of adapting the transport speed of a gathering path by means of which the throughput of a processing system having incorporated therein the gathering path can be improved.

In accordance with a first aspect of the invention, this object is achieved by a method of controlling the transport speed of a transport and gathering unit, wherein filling-material stacks are moved from an inlet to an outlet of the gathering path making use of at least one transport means and wherein filling-material units can selectively be added to the filling-material stacks at one or at several adding stations, the method comprising the steps of:

determining at least one measure for each filling-material stack at the inlet of the gathering path;

increasing each measure for each filling-material stack at each adding station by a respective value corresponding to the filling-material unit added, if the filling-material stack has added thereto a filling-material unit;

comparing each measure of each filling-material stack with a respective set value associated with the transport means; and controlling the transport speed in dependence upon the result of the comparison.

The measure for each filling-material stack is preferably the number of sheets and/or the height and/or the weight of the filling-material stack. If a measure exceeds an associated set value, the processing speed, i.e. the transport speed of the gathering path, will be reduced until the filling-material stack whose measure exceeds the set value has left the gathering path.

The gathering path can comprise a plurality of transport means modules which are arranged one behind the other, each transport means module being driven by a motor of its own. The filling-material stacks are advanced from a respective transport means module located at the rear in the direction of movement to a transport means module located at the front in the direction of movement, each transport means module having at least one total set value of its own, and the transport speed of all transport means modules being reduced if a measure of a filling-material stack exceeds a set value of a transport means module on which the filling-material stack is positioned.

In accordance with a second aspect of the invention, this object is achieved by a method of controlling the transport speed of a transport and gathering unit, wherein filling-material stacks are moved from an inlet to an outlet of the gathering path making use of at least one transport means and wherein filling-material units can selectively be added to the filling-material stacks at one or at several adding stations, the method comprising the steps of:

determining at least one measure for each filling-material stack at the inlet of the gathering path;

increasing each measure for each filling-material stack at each adding station by a respective value corresponding to the filling-material unit added, if the filling-material stack has added thereto a filling-material unit;

determining at least one total measure for all filling-material stacks which are positioned on a transport means on the basis of the measures ascertained for these filling-material stacks;

comparing each total measure with a respective total set value associated with this transport means; and controlling the transport speed in dependence upon the result of the comparison.

Thus, a total measure for all filling-material stacks positioned on a transport means or a transport means module can be determined on the basis of the measures ascertained for these filling-material stacks, the transport speed being controlled on the basis of this total measure.

The present invention provides a method of automatically adapting the processing speed of e.g. a paper handling system in dependence upon the weight and the height of the filling material in the paper handling system, i.e. the enveloping system. A preferred embodiment of the method according to the present invention serves to adapt the processing speed of a paper handling system operating in cycles. The individual cycles are referred to as enveloping cycles in this connection. According to this embodiment of the present invention, the processing speed for each enveloping cycle is adapted to the instantaneous charging of the paper handling system with regard to the filling-material height, which can also be referred to as filling-material thickness, and the filling-material weight.

One advantage of the present invention in comparison with known paper handling systems is the optimized processing speed in the processing of filling-material stacks having different processing quantities, i.e. different heights or different weights. This results in an improved cost/performance ratio as far as the selection of the drive means is concerned.

BRIEF DESCRIPTION OF THE DRAWINGS

In the following, preferred embodiments of the present invention will be described in detail making reference to the drawings enclosed, in which.

DESCRIPTION OF PREFERRED EMBODIMENTS OF THE INVENTION

The method according to the present invention will be explained in the following on the basis of an enveloping system; it is, however, apparent that the method according to the present invention can be used for operating an arbitrary processing system by means of which filling-material stacks are transported and by means of which filling-material units are added to the filling-material stacks.

Figure 1:
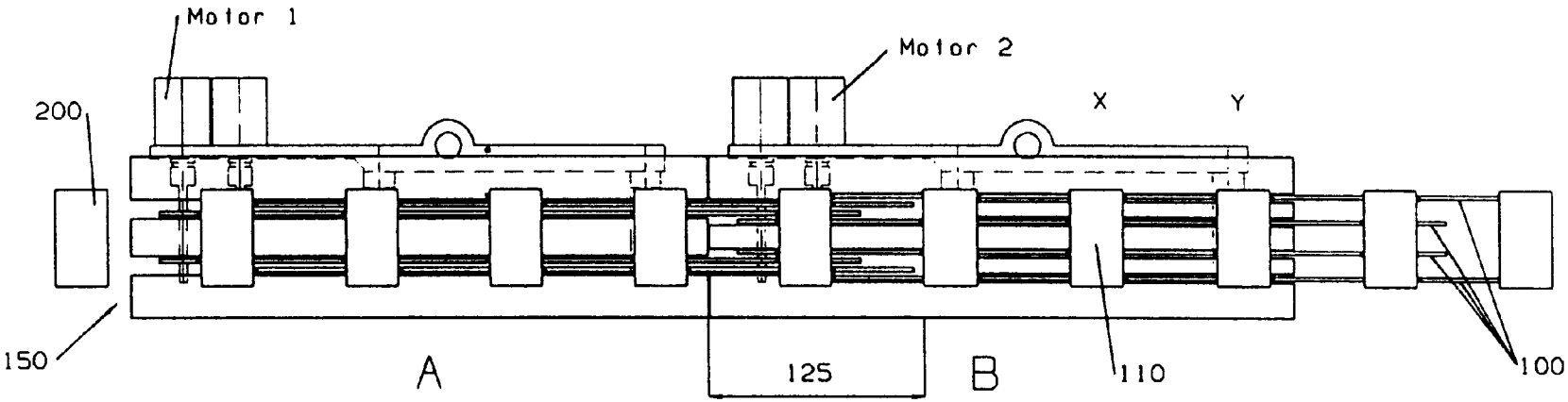
FIG. 1 shows a section of a gathering path f or which the method according to the present invention can be used.

FIG. 1 shows two transport modules A and B constituting part of an enveloping system. The transport modules A and B include conveyor belts 100 having secured thereto pushers and stoppers. The pushers and stoppers are secured to the conveyor belt 100 in such a way that they define respective compartments in which filling-material stacks, i.e. stacks of sheets, booklets or groups of sheets 110, can be transported. The conveyor belts of said transport modules A and B are arranged in such a way that they overlap in an overlapping area 125. This permits a stack of filling-material to be transferred from transport module A to transport module B.

The conveyor belts of transport module A are driven by a drive means which is referred to as motor 1. The conveyor belts of transport module B are driven by a drive means which is referred to as motor 2. The motors, motor 1 and motor 2, have set values which indicate up to which filling height and up to which filling weight the conveyor belts can be operated at a maximum speed. If the filling height or the filling weight of a filling-material stack to be transported exceeds these set values, the system will have to be operated at a lower operating speed.

The motors, motor 1 and motor 2, are driven step by step, i.e. the transport of the filling-material stacks takes place in enveloping cycles. During an enveloping cycle, a filling-material stack is transported from a respective first stop point to a second stop point. The filling-material stack 110, for example, is transported from stop point x to stop point y during an enveloping cycle. The two transport modules A and B shown in FIG. 1 have together ten stop points. An insert station can be arranged at each stop point. At such an insert station, a filling-material unit, i.e. an individual sheet or booklet or groups of sheets, can be added to a filling-material stack, i.e. to a stack of sheets which is already transported on the gathering path. An input stack 200 is transferred to transport module A at the inlet 150 thereof by means of a so-called collecting and transfer point. In the condition of the gathering path shown in FIG. 1, the input stack 200 is not yet on the transport module A. While being transported along the gathering path, the input stack can have added thereto further filling-material units at different insert stations or arbitrary passages ending in the gathering path, although this is not explicitly shown in the figures.

The enveloping system is also provided with a control means and a data transmission line referred to as system field bus. The control means is connected to every motor, e.g. to motor 1 and motor 2, via the system field bus.

In the case of each individual sheet supplied to the enveloping station, information on the weigth and the thickness of the sheet is transmitted to the control means on the system field bus. The control means uses this information for calculating the filling-material thickness, i.e. the filling height, and the filling weight of each stack of sheets transported along the gathering path. On the basis of the transport cycle chosen, a defined period of time for the control operation is available before each enveloping cycle; in this defined period of time, the predetermined speed of the next enveloping cycle can be calculated on the basis of the input conditions, i.e. the filling height and the filling weight of all filling-material units supplied and of the respective input stacks. Before the next enveloping cycle begins, the control value for the speed is synchronously transmitted to all drive motors, e.g. motor 1 and motor 2, via the system field bus.

It follows that the control means collects a measure of all the filling-material units supplied to the enveloping system, viz. of the input stack supplied at the collecting and transfer point and of all the filling-material units supplied at the various insert stations. According to the preferred embodiment, the measure of each filling-material stack having added thereto a filling-material unit at a stop point is determined prior to the enveloping cycle in the course of which the filling-material unit from the insert station is actually added to said filling-material stack.

These determined measures of the filling-material stacks are compared with the set value of the respective motor on the transport module of which the filling-material stack will be positioned during the next enveloping cycle. If the measure of a filling-material stack exceeds the set value of a motor, the speed of all motors will be reduced to a low speed in a controlled manner.

Figure 2:
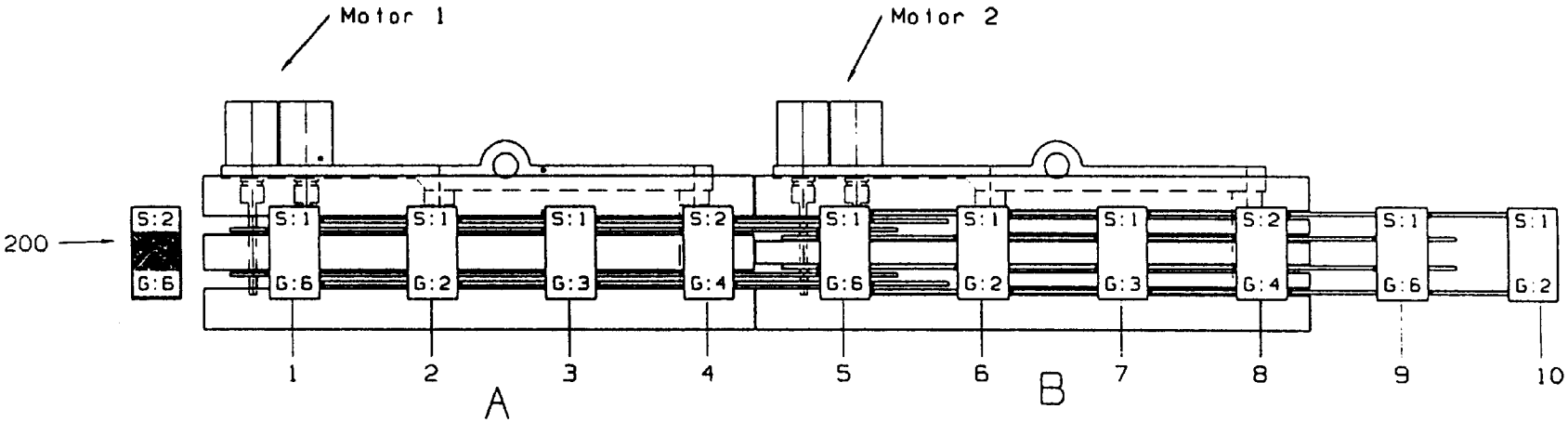
FIG. 2 shows the section of the gathering path of FIG. 1 before an enveloping cycle 1 begins.

A specific embodiment of the method according to the present invention in the case of which the speed is controlled in dependence upon previously determined total measures will be explained in detail hereinbelow making reference to FIG. 2 to 4 and tables I to V. FIG. 2 shows the part of an enveloping system which is shown in FIG. 1 before an enveloping cycle 1 is started. The input stack 200 is positioned at the inlet of the transport module A and is transferred to said transport module A during the first enveloping cycle. The input stack has a filling height of 2 and a filling weight of 6, as can be seen from the designations "S:2" and "G:6". Four filling-material stacks are positioned at four stop points 1 to 4 of transport module A, and four filling-material stacks are also positioned at four stop points 5 to 8 of transport module B. In FIG. 2, two additional stop points 9 and 10 are shown, which, however, belong to a subsequent transport module and which are insofar not important as far as transport modules A and B are concerned. Each of these filling-material stacks at stop points 1 to 10 has a specific filling height and a specific filling weight.

Table I shows parameters of motors which are associated with different transport modules of a gathering path. The two transport modules A and B, which have associated therewith motor 1 and motor 2, respectively, are shown in the figures. The other motors 3 to 5 are not shown in the figures. The table shows the respective stop points associated with the motors, the limit value for the filling height for a maximum speed Vmax and the limit value for the filling weight for the maximum speed Vmax.

TABLE I

| motor | associated stop points | limit value filling height for Vmax | limit value filling weight for Vmax |
|---|---|---|---|
| motor 1 | 1,2,3,4 | 6 | 16 |
| motor 2 | 5,6,7,8 | 6 | 16 |
| motor 3 | 9,10 | 4 | 12 |
| motor 4 | 11,12 | 4 | 12 |
| motor 5 | 13,14 | 4 | 12 |

The limit value or set value of the filling height for motor 1 is, for example, 6, i.e. when the filling height of the filling-material stacks to be transported on transport module A, which is associated with motor 1, exceeds this limit value or set value, the transport speed must be reduced in a controlled manner from Vmax to a lower value. The same applies when the filling weight of the filling-material stacks to be transported exceeds the set value for the filling weight, 16. This applies in the same manner to motors 2 to 5 with regard to the limit values which these motors have.

Table II shows the filling heights and the filling weight of the filling-material stacks positioned at the respective stop points prior to the first enveloping cycle. Furthermore, the sums of the filling heights and filling weights for the respective motors are shown.

TABLE II

| stop point | value filling height | sum for motor | value filling weight | sum for motor |
|---|---|---|---|---|
| 1 | 1 | 5 | 6 | 15 |
| 2 | 1 | | 2 | |
| 3 | 1 | | 3 | |
| 4 | 2 | | 4 | |
| 5 | 1 | 5 | 6 | 15 |
| 6 | 1 | | 2 | |
| 7 | 1 | | 3 | |
| 8 | 2 | | 4 | |
| 9 | 1 | 2 | 6 | 8 |
| 10 | 1 | | 2 | |
| 11 | 1 | 3 | 3 | 7 |
| 12 | 2 | | 4 | |
| 13 | 1 | 2 | 6 | 6 |
| 14 | 1 | | 2 | |

As can be seen in Table II, none of the limit values is exceed in the case of any of the motors. Hence, the system can continue to operate at the maximum processing speed Vmax.

During enveloping cycle 1, the input stack 200 is supplied. The filling-material stack 200 does not yet constitute a load on transport module A and, consequently, on motor 1 during enveloping cycle 1, since said input stack 200 is supplied through the collecting and transfer point and it still constitutes a load on said collecting and transfer point during enveloping cycle 1. Hence, stop point 1 has not associated therewith any load in table III.

TABLE III

| information new material | | | | |
|---|---|---|---|---|
| filling height | filling weight | | | |
| 2 | 6 | | | |
| stop point | value filling height | sum for motor | value filling weight | sum for motor |
| 1 | | 3 | | 11 |
| 2 | 1 | | 6 | |
| 3 | 1 | | 2 | |
| 4 | 1 | | 3 | |
| 5 | 2 | 5 | 4 | 15 |
| 6 | 1 | | 6 | |
| 7 | 1 | | 2 | |
| 8 | 1 | | 3 | |
| 9 | 2 | 3 | 4 | 10 |
| 10 | 1 | | 6 | |
| 11 | 1 | 2 | 2 | 5 |
| 12 | 1 | | 3 | |
| 13 | 2 | 3 | 4 | 10 |
| 14 | 1 | | 6 | |

Table III shows the occupancy of the various stop points 1 to 14 during enveloping cycle 1, the input stack 200 being supplied during this enveloping cycle. As can be seen from table III, none of the limit values of motors 1 to 5 is infringed during this enveloping cycle. Hence, the system is operated at Vmax.

Figure 3:
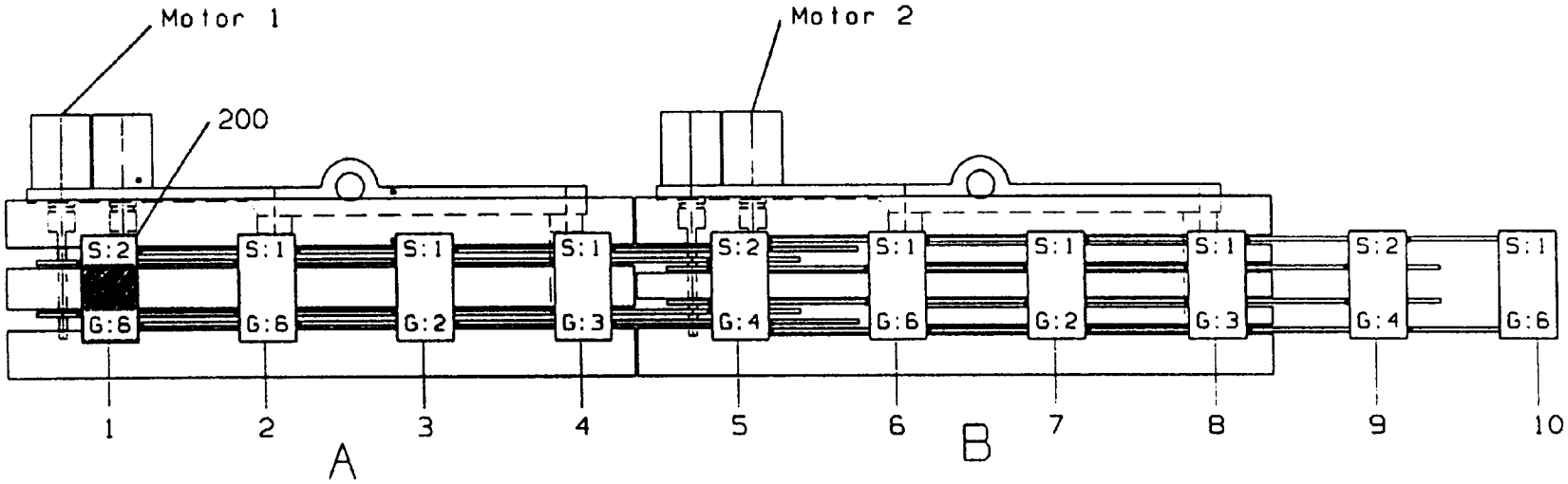
FIG. 3 shows the section of the gathering path of FIG. 1 before the end of enveloping cycle 1.

FIG. 3 shows the transport modules A and B at the end of enveloping cycle 1. Each of the filling-material stacks has been advanced by one stop point. For example, the filling-material stacks which were previously positioned at stop points 2 to 4 are now positioned at stop points 3 to 5. Furthermore, the input stack 200 is located at stop point 1 at the end of enveloping cycle 1 and contributes consequently to the load on motor 1, which is associated with transport module A.

TABLE IV

| stop point | value filling height | sum for motor | value filling weight | sum for motor |
|---|---|---|---|---|
| 1 | 2 | 5 | 6 | 17 |
| 2 | 1 | | 6 | |
| 3 | 1 | | 2 | |
| 4 | 1 | | 3 | |
| 5 | 2 | 5 | 4 | 15 |
| 6 | 1 | | 6 | |
| 7 | 1 | | 2 | |
| 8 | 1 | | 3 | |
| 9 | 2 | 3 | 4 | 10 |
| 10 | 1 | | 6 | |
| 11 | 1 | 2 | 2 | 5 |
| 12 | 1 | | 3 | |
| 13 | 2 | 3 | 4 | 10 |
| 14 | 1 | | 6 | |

Table VI shows the charging of stop points 1 to 14 as well as the sum of the filling heights and filling weights for each motor before the end of the first enveloping cycle. As can be seen from table IV, the sum of the filling weights of the filling-material stacks occupying stop points 1 to 4 is 17. It follows that the sum of the filling weights for motor 1 exceeds the limit value of said motor, said limit value being 16. The control means detects this upon comparing the sum of the filling weights of the filling-material stacks positioned at stop points 1 to 4 and the filling-weight set value for motor 1. Hence, it controls all the motors such that they operate at a reduced speed during the next enveloping cycle. The control means will not reestablish the speed Vmax of said motors until the sum of the filling weights of the filling-material stacks at stop points 1 to 4 no longer exceeds the filling-weight limit value of motor 1 and no other set value or limit value is infringed either.

Figure 4:
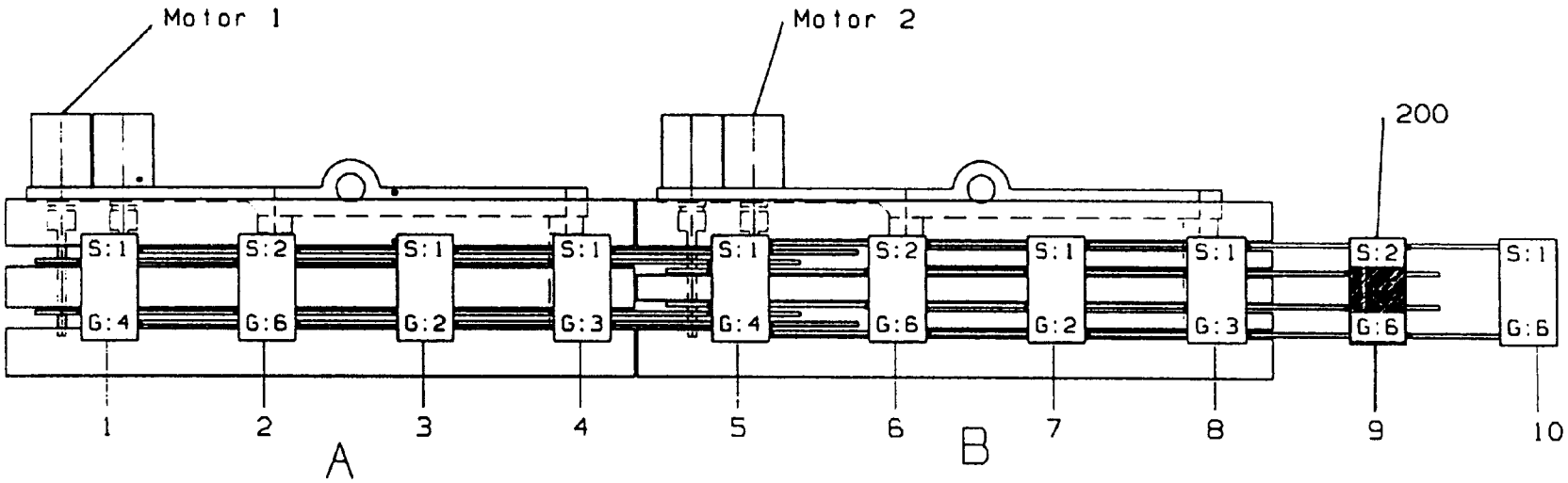
FIG. 4 shows the section of the gathering path of FIG. 1 before the end of an enveloping cycle 9.

In FIG. 4, transport modules A and B are shown at the end of enveloping cycle 9. Furthermore, table v shows the parameters of the filling-material stacks at stop points 1 to 14 as well as the sums of the filling heights and of the filling weights thereof for motors 1 to 5.

TABLE V

| stop point | value filling height | sum for motor | value filling weight | sum for motor |
|---|---|---|---|---|
| 1 | 1 | 5 | 4 | 15 |
| 2 | 2 | | 6 | |
| 3 | 1 | | 2 | |
| 4 | 1 | | 3 | |
| 5 | 1 | 5 | 4 | 15 |
| 6 | 2 | | 6 | |
| 7 | 1 | | 2 | |
| 8 | 1 | | 3 | |
| 9 | 2 | 4 | 6 | 12 |
| 10 | 2 | | 6 | |
| 11 | 1 | 2 | 2 | 5 |
| 12 | 1 | | 3 | |
| 13 | 1 | 3 | 4 | 10 |
| 14 | 2 | | 6 | |

As can be seen from table V, none of the limit values of motor 1 to 5 is infringed by the filling-material stacks occupying the respective stop points. Hence, the control means controls the motors such that they operate at the maximum speed Vmax during the next enveloping cycle. In this connection, reference should be made to the fact that, before the end of the eighth enveloping cycle, the filling-material stack 200, the former input stack, was positioned at stop point 8. It follows that the total filling weight of stop points 5 to 8, which are associated with motor 2, was 17. This value is higher than the filling-weight limit value of motor 2, which is 15. Hence, the motors are operated at a reduced speed during the ninth enveloping cycle. Since all limit values are fulfilled at the end of the ninth enveloping cycle, the control means controls the motors such that they will operate at the maximum speed Vmax during the tenth enveloping cycle.

This control operation is based on an information model in the case of which each motor has associated therewith a specific segment of the process image. These segments correspond to the number of transport goods which are to be transported by a motor per cycle. Hence, it is possible to ascertain for each individual motor the acceleration moments for the next cycle and thus to determine the predetermined speed for the next cycle.

The control method described hereinbefore with regard to the input filling-material stack 200 when said stack runs through a transport and gathering path without having added thereto a filling-material unit at an insert station can be applied to arbitrary transport and gathering paths in the case of which filling-material units are added to a filling-material stack by means of an insert station. The filling height for this filling-material stack for the next enveloping cycle is then the original filling height plus the filling height of the filling-material unit added by means of the insert station. The filling weight of this filling-material stack is then the original filling weight plus the filling weight of the filling-material unit added at the insert station.

It follows that the method according to the present invention optimizes the transport speed within a gathering path, belonging to e.g. an enveloping system, in dependence upon the height and/or the weight of the filling material. Taking as a basis the number or the weight of the sheets in a collecting and transfer point, it is currently calculated or counted at which point within the gathering path which height or which weight of the filling-material stack has been reached, a reduction of the operating speed of the gathering path being carried out at the moment at which a stack exceeds a limit value. In the case of a gathering path consisting of a different transport modules, different limit values can then be valid for the different transport modules which are each operated by a motor and which have associated therewith different stop points; in this connection it will be necessary to control all the motors such that they operate at a lower speed even if the relevant limit value is exceeded at only one stop point. The method according to the present invention is not limited to switching backwards and forwards between two speed stages in the case of two limit values, but it also includes a stepped speed control in dependence upon calculated filling-height values and/or filling-weight values; in this case, the transport means or each transport module has associated therewith a plurality of set values for both the filling weight and the filling height.

The method according to the present invention can, consequently, be applied to gathering paths driven by only one motor as well as to modular gathering paths in the case of which individual transport modules are driven by respective motors of their own. In the last-mentioned case, all the motors must be controlled such that they operate at a lower speed when a limit value of one motor is exceeded.

In accordance with one embodiment of the method according to the present invention, at least one measure of a filling-material stack is compared with a set value. In the case of an enveloping means, the number of sheets, the height and/or the weight of the filling-material stack can be used. According to the present invention, each of these measures can be compared with a set value, the transport speed of the transport and gathering unit being reduced in a controlled manner when an arbitrary one of these measures exceeds the associated set value. It is obvious that it is also possible to use only one measure or a larger number of measures for each filling-material stack.

According to the embodiment of the present invention described with regard to FIG. 2 to 4, total measures are determined for all filling-material stacks transported by the motor of a transport means. In an enveloping system, these measures can be the total number of sheets, the total height and/or the total weight of the filling-material stacks transported by this motor. It is again possible to compare an arbitrary number of these total measures with set values which belong thereto and which are associated with this motor.

It is also possible to determine for one parameter of the filling-material stacks transported by a motor a total measure which is compared with a set value of said motor, whereas for another parameter of the filling-material stacks a measure is determined for each filling-material stack. In this way, it is possible to compare the total weight of all filling-material stacks which are to be transported by a motor with a filling-weight limit value or filling-weight set value of said motor, whereas e.g. the height of each individual filling-material stack is compared with a set value of said motor, said set value corresponding to a filling-material-stack height that can be transported at a maximum speed.

What is claimed is:

1. A method of controlling the transport speed of a transport and gathering unit, wherein filling-material stacks are moved from an inlet to an outlet of the gathering path making use of at least one transport means and wherein filling-material units can selectively be added to said filling-material stacks at one or at several adding stations, said method comprising the steps of:

a1) determining at least one measure for each filling-material stack at the inlet of the gathering path;

b1) increasing each measure for each filling-material stack at each adding station by a respective value corresponding to the filling-material unit added, if the filling-material stack has added thereto a filling-material unit;

c1) comparing each measure of each filling-material stack with a respective set value associated with the transport means; and d1) controlling the transport speed in dependence upon the result of said comparison.

2. A method according to claim 1, wherein the transport speed is reduced as long as at least one measure of at least one filling-material stack exceeds the respective set value, the transport speed being increased again when the respective set value is no longer exceeded by any measure.

3. A method according to claim 1, wherein step c1) includes comparing each measure with several set values so as to carry out a speed control in steps depending on the result of these comparisons.

4. A method according to claim 1 for controlling the transport speed of such a gathering path, wherein the transport means consists of a plurality of transport means modules which are arranged one behind the other, the filling-material stacks being advanced from a respective transport means module located at the rear in the direction of movement to a transport means module located at the front in the direction of movement, said method including the method step of reducing the transport speed of all transport means modules as long as at least one measure of a filling-material stack exceeds a set value of a transport means module on which said filling-material stack is positioned.

5. A method according to claim 1, wherein, prior to step c1), at least one total measure for all filling-material stacks positioned on a transport means or a transport module is additionally determined on the basis of the measures ascertained for these filling-material stacks, each total measure ascertained in step c1) being compared in step d1) with a respective total set value associated with said transport means or transport means module, the transport speed being additionally controlled in dependence upon the result of said comparison.

6. A method according to claim 5, wherein the measure on the basis of which the total measure is determined is the weight of the filling-material stacks.

7. A method of controlling the transport speed of a transport and gathering unit, wherein filling-material stacks are moved from an inlet to an outlet of the gathering path making use of at least one transport means and wherein filling-material units can selectively be added to said filling-material stacks at one or at several adding stations, said method comprising the steps of:

a2) determining at least one measure for each filling-material stack at the inlet of the gathering path;

b2) increasing each measure for each filling-material stack at each adding station by a respective value corresponding to the filling-material unit added, if the filling-material stack has added thereto a filling-material unit;

c2) determining at least one total measure for all filling-material stacks which are positioned on a transport means on the basis of the measures ascertained for these filling-material stacks;

d2) comparing each total measure with a respective total set value associated with this transport means; and e2) controlling the transport speed in dependence upon the result of said comparison.

8. A method according to claim 7, wherein the transport speed is reduced as long as at least one total measure exceeds the associated total set value, the transport speed being increased again when the associated total set value is no longer exceeded by any total measure.

9. A method according to claim 7, wherein step d2) includes comparing each total measure with several total set values so as to carry out a speed control in steps depending on the result of these comparisons.

10. A method according to claim 7 for controlling the transport speed of such a gathering path, wherein the transport means consists of a plurality of transport means modules which are arranged one behind the other, the filling-material stacks being advanced from a respective transport means module located at the rear in the direction of movement to a transport means module located at the front in the direction of movement, each transport means module having at least one total set value of its own, said method including the method step of reducing the transport speed of all transport means modules as long as at least one total measure of all filling-material stacks which are positioned on a transport module exceeds the respective total set value of this transport module.

11. A method according to claim 4, wherein each transport module is driven by means of a motor of its own.

12. A method according to claim 10, wherein each transport module is driven by means of a motor of its own.

13. A method according to claim 1, wherein the increase of each measure for each filling-material stack is carried out before the respective filling-material unit is added to the filling-material stack.

14. A method according to claim 7, wherein the increase of each measure for each filling-material stack is carried out before the respective filling-material unit is added to the filling-material stack.

15. A method according to claim 1, wherein, making use of the transport means, the filling-material stacks are cyclically moved in such a way that, during intervals between the movements, filling-material stacks are positioned at respective stop points, adding stations or processing stations being arranged at said stop points.

16. A method according to claim 7, wherein, making use of the transport means, the filling-material stacks are cyclically moved in such a way that, during intervals between the movements, filling-material stacks are positioned at respective stop points, adding stations or processing stations being arranged at said stop points.

17. A method according to claim 15, wherein steps b1) and c1) as well as steps b2), c2) and d2) are each carried out during the intervals between the movements before the next cycle.

18. A method according to claim 16, wherein steps b2), c2) and d2) are each carried out during the intervals between the movements before the next cycle.

19. A method according to claim 1, wherein the measure for each filling-material stack is the number of sheets and/or the height and/or the weight of the filling-material stack.

20. A method according to claim 7, wherein the measure for each filling-material stack is the number of sheets and/or the height and/or the weight of the filling-material stack.

21. A method according to claim 1, wherein the respective set values are each associated with one motor of the transport means or of the transport means modules.

22. A method according to claim 7, wherein the respective set values are each associated with one motor of the transport means or of the transport means modules.

* * * * *

UNITED STATES PATENT AND TRADEMARK OFFICE

CERTIFICATE OF CORRECTION

PATENT NO. : 6,895,303 B1
DATED : May 17, 2005
INVENTOR(S) : Krumm, Josef and Batzer, Josef It is certified that error appears in the above-identified patent and that said Letters Patent is hereby corrected as shown below:

Title page,
Insert Item -- [73] Assignee: Bow Systec AG, (DE) --.

Signed and Sealed this

Sixth Day of September, 2005

JON W. DUDAS
*Director of the United States Patent and Trademark Office*

UNITED STATES PATENT AND TRADEMARK OFFICE

CERTIFICATE OF CORRECTION

PATENT NO. : 6,895,303 B1
DATED : May 17, 2005
INVENTOR(S) : Krumm, Josef and Batzer, Josef It is certified that error appears in the above-identified patent and that said Letters Patent is hereby corrected as shown below:

Title page,
Insert Item -- [73] Assignee: Böwe Systec AG, (DE) --.

This certificate supersedes Certificate of Correction issued September 6, 2005.

Signed and Sealed this

Thirteenth Day of December, 2005

JON W. DUDAS
*Director of the United States Patent and Trademark Office*